US005471818A

United States Patent [19]

Hannen

[11] Patent Number: 5,471,818

[45] Date of Patent: Dec. 5, 1995

[54] SHRINK WRAPPING PALLETIZED GOODS

[75] Inventor: Reiner Hannen, Goch-Pfalzdorf, Germany

[73] Assignee: MSK-Verpackungs-Systeme Gesellschaft Mit Beschrankter Haftung, Kieve, Germany

[21] Appl. No.: 271,516

[22] Filed: Jul. 7, 1994

[30] Foreign Application Priority Data

Jul. 9, 1993 [DE] Germany ..... 9310218 U

[51] Int. Cl.[6] ..... B65B 53/02

[52] U.S. Cl. ..... 53/442; 53/557

[58] Field of Search ..... 53/442, 557

[56] References Cited

U.S. PATENT DOCUMENTS

| | | | |
|---|---|---|---|
| 3,581,458 | 6/1971 | Gustavsson | 53/442 |
| 3,710,550 | 1/1973 | Osborne | 53/557 X |
| 3,723,708 | 3/1973 | Tulkoff | 53/557 X |
| 3,930,790 | 1/1976 | Rogosch | 53/442 X |
| 4,724,658 | 2/1988 | Birkenfeld et al. | 53/442 X |
| 4,866,916 | 9/1989 | Hannen et al. | 53/442 X |

*Primary Examiner*—Linda Johnson
*Attorney, Agent, or Firm*—Herbert Dubno; Andrew Wilford

[57] ABSTRACT

An apparatus for shrinking a heat-shrinkable hood over a stack of goods has an upright guide adjacent the hooded stack of goods, an upper frame vertically displaceable on the guide and provided with a heater capable of shrinking the hood and a lower frame below the upper frame, vertically displaceable on the guide below the upper frame, and provided with a heater capable of shrinking the hood. Respective upper and lower drives connected to the frames vertically displace same on the guide independently of each other. First the stack of goods is positioned in a treatment station with the hood pulled down over the goods, a lower end edge of the hood hanging down below a lower end of the stack of goods, and an upper closed end of the hood on an upper surface of the stack of goods. Then to secure the hood in place the hanging-down lower end edge of the hood is heated to shrink it in under the lower end of the stack of goods. At the same time the upper closed end of the hood is heated while moving a lower heater vertically upward from the lower end edge of the hood to simultaneously shrink the upper closed end down onto the upper surface of the stack while shrinking side regions of the hood inward into engagement with side surfaces of the stack of goods.

7 Claims, 1 Drawing Sheet

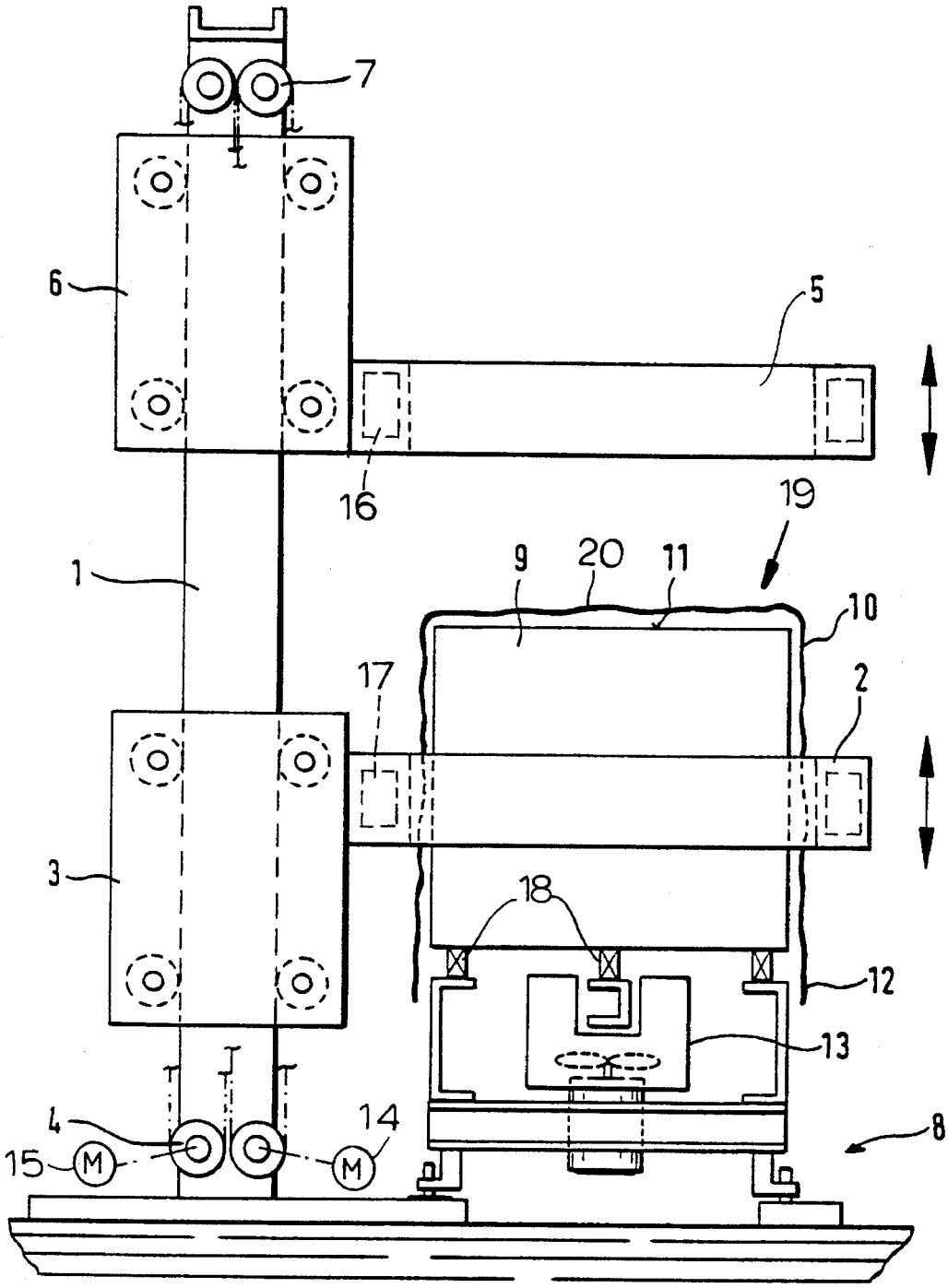
7
6
5
16
19
1
9
20
11
10
17
2
3
18
12
13
4
14
15
M
M
8

SHRINK WRAPPING PALLETIZED GOODS

FIELD OF THE INVENTION

The present invention relates to shrink wrapping palletized goods. More particularly this invention concerns a method of and apparatus for shrinking a synthetic-resin bag or hood over a stack of goods carried on a pallet.

BACKGROUND OF THE INVENTION

It is known, for instance from commonly owned U.S. Pat. No. 5,042,235 to shrink wrap palletized goods by first placing a thermoplastic lower foil atop a pallet with edges of the foil projecting laterally past the pallet and then stacking goods on the pallet atop the foil on the pallet within the edges of the foil. The lower edge of a downwardly open heat-shrinkable foil hood is held as the hood is fitted downward over the stack on the pallet until the lower edge is generally below the stack. This lower edge is then gripped below the stack and the foil hood is shrunk from top to bottom around the stack while continuing to grip the lower edge below the stack. Finally the foil hood is welded to the outer edge of the lower foil. Thus when the grippers are carried on the same vertically displaceable frame as the heater/blowers it is possible for the grippers to release and move upward before the top-to-bottom shrinking of the hood. During such shrinking the clamps will prevent the hood or sack from riding up too much.

The apparatus for doing this has as described in U.S. Pat. No. 5,018,339 a transport device defining a support surface for displacing the palletized goods in a transport direction and including an upstream conveyor, a station conveyor spaced downstream by an upstream gap from the upstream conveyor, and a downstream conveyor spaced downstream by a downstream gap from the station conveyor. A heat ring has upstream and downstream portions and side portions extending in the direction therebetween. This ring is displaceable between a lower position with the upstream and downstream portions in the gaps below the surface and the side portions flanking the station conveyor and an upper position above the surface. An actuator displaces the ring between its upper and lower positions. Thus the ring need merely be moved upward once the pallet is positioned on the station conveyor within it to preshrink the wrap and drive out the air in it, then is moved down once to its starting position to fully shrink the wrap in place.

While these systems are relatively effective, they take some time shrinking the hood around a large stack of palletized goods. In fact this shrink-wrapping operation can constitute a substantial bottleneck in production.

OBJECTS OF THE INVENTION

It is therefore an object of the present invention to provide an improved method of and apparatus for shrinking a heat-shrinkable hood around a stack of goods.

Another object is the provision of such an improved method of and apparatus for shrinking a heat-shrinkable hood around a stack of goods which overcomes the above-given disadvantages, that is which is very fast.

SUMMARY OF THE INVENTION

An apparatus for shrinking a heat-shrinkable hood over a stack of goods has according to the invention an upright guide adjacent the hooded stack of goods, an upper frame vertically displaceable on the guide and provided with a heater capable of shrinking the hood and a lower frame below the upper frame, vertically displaceable on the guide below the upper frame, and provided with a heater capable of shrinking the hood. Respective upper and lower drives connected to the frames vertically displace same on the guide independently of each other.

Thus with the system of this invention there are two separate heater-equipped frames so that the processing time is cut at least in half. Furthermore according to the invention the heater of the upper frame is specifically designed to shrink a closed upper end of the hood. Thus the top end of the hood can be shrunk in place by this special-duty frame while the rest of the hood is itself shrunk around the goods.

In accordance with this invention both frames are annular with a central opening through which the stack of goods can pass vertically on vertical displacement of the frames. In addition each drive includes a respective motor and these drives are operated by a controller wholly independently of each other. The guide is an upright post and each frame includes a respective carriage vertically displaceable thereon. The upper-frame carriage is above the lower-frame carriage.

The method of this invention thus comprises the steps of first positioning the stack of goods in a treatment station with the hood pulled down over the goods, a lower end edge of the hood hanging down below a lower end of the stack of goods, and an upper closed end of the hood on an upper surface of the stack of goods. Then to secure the hood in place the hanging-down lower end edge of the hood is heated to shrink it in under the lower end of the stack of goods. Subsequently simultaneously the upper closed end of the hood is heated while moving a lower heater vertically upward from the lower end edge of the hood to simultaneously shrink the upper closed end down onto the upper surface of the stack while shrinking side regions of the hood inward into engagement with side surfaces of the stack of goods.

Normally according to the invention the shrinking of the lower end edge and of the side regions are both done by a lower heater and the shrinking of the upper closed end is done by a separate upper heater. Both heaters are moved upward clear of the stack of goods after the shrinking is complete.

BRIEF DESCRIPTION OF THE DRAWING

The above and other objects, features, and advantages will become more readily apparent from the following description, reference being made to the drawing whose sole figure is a largely schematic side view of an apparatus according to the invention.

SPECIFIC DESCRIPTION

As seen in the drawing a vertical support post 1 carries vertically movable carriages or guides 3 and 6 for lower and upper heat rings or frames 2 and 5 provided with respective heaters 17 and 16. A transmission 4 and motor 15 move the lower guide 3 and frame 2 and another such transmission 7 and motor 14 displace the upper guide 6 and frame 5 independently of the lower unit.

A stack of goods 9 on a pallet 18 is carried on a conveyor 8 provided at a station 19 with a blower 13. A heat-shrinkable hood or bag 10 is pulled over the goods 9 so that it forms a skirt 12 hanging down somewhat past the lower edge of the goods 9 and an upper closed end 20 of the hood 10 lies on an upper surface 11 of the stack of goods 9.

The apparatus described above is operated as follows:

To start with the goods 9 with the hood 10 are positioned in the station 19 with both the frames 2 raised above the plane of the upper surface 11.

Then both frames 2 and 5 are moved downward. The upper frame 5 is maintained a slight distance, e.g. 150 mm, above the upper surface 11. Its heater 16 is normally of the gas-fired type and is set up to direct a blast of hot gas over the entire upper surface 11 of the stack of goods 9.

Meanwhile the lower frame 2 is dropped down level with the skirt 12 and is turned on to shrink this skirt 12 inward, thereby securing the lower edge of the bag 10 underneath the goods 9 to the pallet 18. The blower 13 is operated during this operation to draw in the skirt 12 so it is not stuck to the conveyor 8.

Then the lower frame 2 is lifted to shrink the hood 10 tight around the goods 9 while the upper frame 5 shrinks the end 20 of the hood 10. When the lower frame 2 or its guide 3 comes up against the upper frame 5 or its guide 6 both frames 2 and 5 are lifted and both heaters 16 and 17 are turned off. The shrinking operation is complete.

Both frames 2 and 3 can be formed as rings with central holes shaped to fit around the palletized stack of goods 9. This allows, if desired, the upper frame 5 to be dropped down toward the rising lower frame 2 if desired to further speed the shrinking operation.

I claim:

1. An apparatus for shrinking a heat-shrinkable hood over a stack of goods, the apparatus comprising:

an upright guide adjacent the hooded stack of goods;

an upper frame vertically displaceable on the guide and provided with a heater capable of shrinking the hood;

a lower frame below the upper frame, vertically displaceable on the guide independently of and below the upper frame, and provided with a heater capable of shrinking the hood; and respective upper and lower drive means connected to the frames for vertically displacing same on the guide independently of each other.

2. An apparatus for shrinking a heat-shrinkable hood over a stack of goods, the apparatus comprising:

an upright guide adjacent the hooded stack of goods;

an upper frame vertically displaceable on the guide and provided with a heater capable of shrinking the hood and specifically designed to shrink a closed upper end of the hood;

a lower frame below the upper frame, vertically displaceable on the guide independently of and below the upper frame, and provided with a heater capable of shrinking the hood; and respective upper and lower drive means connected to the frames for vertically displacing same on the guide independently of each other.

3. The shrinking apparatus defined in claim 1 wherein both frames are annular with a central opening through which the stack of goods can pass vertically on vertical displacement of the frames.

4. The shrinking apparatus defined in claim 1 wherein each drive means includes a respective motor.

5. The shrinking apparatus defined in claim 1 wherein the guide is an upright post and each frame includes a respective carriage vertically displaceable thereon, the upper-frame carriage being above the lower-frame carriage.

6. A method of shrinking a heat-shrinkable hood onto a stack of goods, the method comprising the steps of sequentially:

a) positioning the stack of goods in a treatment station with the hood pulled down over the goods, a lower end edge of the hood hanging down below a lower end of the stack of goods, and an upper closed end of the hood on an upper surface of the stack of goods;

b) heating the hanging-down lower end edge of the hood by means of a lower heater and thereby shrinking the lower end edge in under the lower end of the stack of goods; and c) simultaneously heating the upper closed end of the hood by means of an upper heater independent of the lower heater while moving the lower heater independently from the upper heater and vertically upward from the lower end edge of the hood to simultaneously shrink the upper closed end down onto the upper surface of the stack while shrinking side regions of the hood inward into engagement with side surfaces of the stack of goods.

7. The shrinking method defined in claim 6, further comprising the step of d) displacing both heaters upward clear of the stack of goods after step c).

* * * * *